US007245086B2

(12) United States Patent
Mitze

(10) Patent No.: US 7,245,086 B2
(45) Date of Patent: Jul. 17, 2007

(54) LAMP OPERATING CIRCUIT AND OPERATING METHOD FOR A LAMP HAVING ACTIVE CURRENT MEASUREMENT

(75) Inventor: Andreas Mitze, Traunreut (DE)

(73) Assignee: Patent-Treuhand-Gesellschaft für Elecktrisch Glühlampen mbH, Munich (DE)

( * ) Notice: Subject to any disclaimer, the term of this patent is extended or adjusted under 35 U.S.C. 154(b) by 0 days.

(21) Appl. No.: 11/253,606

(22) Filed: Oct. 20, 2005

(65) Prior Publication Data

US 2006/0087249 A1 Apr. 27, 2006

(30) Foreign Application Priority Data

Oct. 21, 2004 (DE) ..... 102004051536

(51) Int. Cl.
*H05B 39/04* (2006.01)

(52) U.S. Cl. ..... 315/209 R; 315/291; 315/224; 315/219; 315/308; 315/293

(58) Field of Classification Search ..... 315/209 R, 315/291, 224, 219, 308, 141, 362
See application file for complete search history.

(56) References Cited

U.S. PATENT DOCUMENTS 5,631,523 A * 5/1997 Rothenbuhler et al. ..... 315/307
6,008,593 A * 12/1999 Ribarich ..... 315/307
6,498,437 B1 * 12/2002 Chang et al. ..... 315/141
2005/0035729 A1 * 2/2005 Lev et al. ..... 315/291

FOREIGN PATENT DOCUMENTS

DE 196 13 257 A1 7/1997
WO WO 00/33621 6/2000

OTHER PUBLICATIONS

Search Report from European Patent Office (for related foreign patent application) referencing the above-listed patent documents, dated Mar. 9, 2006 (6 pages total).

* cited by examiner

*Primary Examiner*—Tho Phan
*Assistant Examiner*—Chuc Tran
(74) *Attorney, Agent, or Firm*—Carlo S. Bessone

(57) ABSTRACT

The invention relates to a circuit and to a method for operating a lamp. In this case, a reactance for the purpose of detecting the lamp voltage, a zero point detection device for the purpose of determining the zero crossing of the current through the reactance and a current measuring device and, finally, a track-and-hold circuit triggered by the zero point detection device are used to measure the lamp current in such a way that the influence of parasitic capacitances is still ruled out.

11 Claims, 3 Drawing Sheets

LAMP OPERATING CIRCUIT AND OPERATING METHOD FOR A LAMP HAVING ACTIVE CURRENT MEASUREMENT

TECHNICAL FIELD

The present invention relates to a circuit and to a method for operating a lamp, in particular a discharge lamp, using alternating current. It is concerned in particular with the measurement of the lamp current.

BACKGROUND ART

Circuits for operating lamps using alternating current are known per se. They are in a wide variety of embodiments on the market and are documented in the prior art, for example as electronic transformers for the purpose of operating low-voltage halogen incandescent lamps or as operating circuits for low-pressure discharge lamps, i.e. fluorescent tubes or energy-saving lamps, for example. The latter generally contain a converter for the purpose of producing a radiofrequency supply power for the lamp.

It is furthermore known per se to measure the lamp current during operation, for example in order to regulate this lamp current.

DISCLOSURE OF THE INVENTION

The present invention is based on the technical problem of specifying a circuit and a method for operating lamps using alternating current which are improved in terms of the measurement of the lamp current.

The invention relates to an AC operating circuit for operating a lamp having a reactance for the purpose of detecting the lamp voltage, a mathematical sign-sensitive zero point detection device for the purpose of determining the zero crossing of the current through the reactance, a current measuring device for the purpose of measuring the current through the lamp, and a triggered holding device which is triggered by the zero point detection device such that it detects and then holds the lamp current measured by the current measuring device at a point in time at which this current substantially corresponds to the amplitude of the active current through the lamp, and to a corresponding operating method and to an illumination system comprising such an operating circuit with a lamp supplied thereby.

The description below relates implicitly both to the device aspect and to the method aspect of the invention, without a distinction being drawn in detail between these two aspects.

The inventor has observed that, in the case of AC operating circuits for lamps, relatively large capacitive reactive currents can occur as a result of parasitic capacitances, caused primarily by lamp lines. These reactive currents may be higher, primarily in the case of dimmable lamps, and at the lower dimming settings even a multiple higher, than the actual active current in the lamp. In any case, they falsify the measured current value. In the case of dimmable lamps, at lower dimming settings the lamp may even be extinguished if regulation is effected to the total measured current comprising the lamp current and the capacitive current.

On the basis of this, the actual active current in the lamp should be determined at least approximately in order to rule out such falsifications or functional faults.

In the invention, the lamp voltage is therefore measured using a reactance. The current through the reactance is in this case phase-shifted through 90° with respect to the lamp voltage. Mathematical sign-sensitive determination of the zero crossing of the current in this case allows for determination of points in time which are phase-shifted in a defined manner through 90° with respect to the zero crossing of the lamp voltage. Since the active current in the lamp runs in-phase with the lamp voltage, and the capacitive reactive current to be ruled out in the measurement is phase-shifted through 90°, a measurement of the lamp current can take place in this manner at a point in time at which the capacitive reactive current leading by 90° with respect to the active current is essentially zero, i.e. the measurement detects at least approximately the active lamp current. Specifically, this may take place such that that zero crossing is used at which the active current through the lamp reaches its positive amplitude value.

In this case, the invention is based on the assumption that the parasitic capacitances in the lamp operating circuit by far exceed the influence of parasitic inductances, i.e. falsification of the active current by the capacitive and inductive phase shift being partially canceled out can be disregarded. This is naturally an approximation, but is entirely sufficient owing to the parasitic inductances actually to be disregarded in practice. In any case, the invention offers a marked improvement over the prior art.

A suitable reactance is, in principle, both inductances and capacitances, capacitances being preferred in the context of the invention. They are generally associated with lower component costs and a more favorable physical size. This is also the case in the exemplary embodiment in which, correspondingly, the zero crossing from plus to minus is critical in the measurement of the lamp current.

The invention is preferably based on applications having lamp current regulation, in particular in the case of dimmable lamps. In this case, more precise regulation and, in the case of dimming, also faultless operation even at very low dimming settings can be achieved owing to the more precise determination of the lamp current.

One preferred application is, in addition, discharge lamps in which the operating circuit generally has a converter, for example a half-bridge inverter, for the purpose of producing a substantially square-wave radiofrequency supply voltage for the lamp. In addition, a lamp inductor and a coupling capacitor are provided in series with the lamp. The coupling capacitor defines a reference potential at one terminal of the lamp. The other lamp terminal is at the radiofrequency output of the converter. The coupling capacitor can in this case be connected to the internal reference potential (ground) or else to the supply potential of the converter and in this case establishes, as the reference potential for the lamp, generally the mean value between the internal reference potential and the supply potential of the converter.

In addition, a digital controller is preferably provided which controls the operation of the converter and, in the process, contains the lamp current regulation, if provided. In this case, the clock frequency of the converter can be used for the purpose of effecting regulation to the lamp current. The operating circuit in this case has an analog-to-digital converter in order to supply the lamp current value, which has preferably been obtained in analog fashion, to the digital controller.

The current measuring device can be connected via at least one diode, and can thus only detect current values of one polarity. This may be advantageous in particular when using an analog-to-digital converter since said analog-to-digital converter under some circumstances is designed only for processing input values of one polarity.

The triggered holding device used for detecting and holding the lamp current is preferably a track-and-hold circuit and may have a controlled switch and a capacitor. In this case, the switch position determines whether the capacitor is charged with a voltage signal corresponding to the lamp current value, in particular the voltage drop across a measuring resistor, or is decoupled in order to hold the value "stored" at the time of decoupling.

The zero point detection device used for the purpose of determining the zero crossing may have a measuring resistor connected in series with the reactance, in particular the capacitor, and a comparator or Schmitt trigger detecting the voltage across this measuring resistor or generally a threshold value component.

BRIEF DESCRIPTION OF THE DRAWINGS

The invention will be explained in more detail below with reference to an exemplary embodiment, in which the individual features are significant both for the device aspect and for the method aspect and moreover may also be critical to the invention in other combinations.

BEST MODE FOR CARRYING OUT THE INVENTION

In order to illustrate the exemplary embodiment explained in more detail below, FIG. 1 initially shows a schematic of the design of a conventional illumination system. A discharge lamp is shown in the right-hand upper region. The parasitic line capacitances mentioned initially are illustrated symbolically by a capacitance C_cap lying in parallel with the lamp. The lamp is supplied by a bridge circuit having two half-bridge transistors T1 and T2 which produce a radiofrequency square-wave voltage at their center tap. This radiofrequency square-wave voltage is provided to an electrode via a lamp inductor L_lamp, the other lamp electrode being connected, via a coupling capacitor C8, to the lower supply branch of the half-bridge comprising the two transistors T1 and T2, in this case the internal ground. A resonant capacitor C7, which is provided in the lamp circuit together with the lamp inductor L_lamp for the purpose of producing an excess voltage owing to resonant excitation, lies between the lamp-side terminal of the lamp inductor L_lamp and this internal ground. These relationships are well known to those skilled in the art and have long been the prior art and do not need to be explained in detail here.

Figure 1:
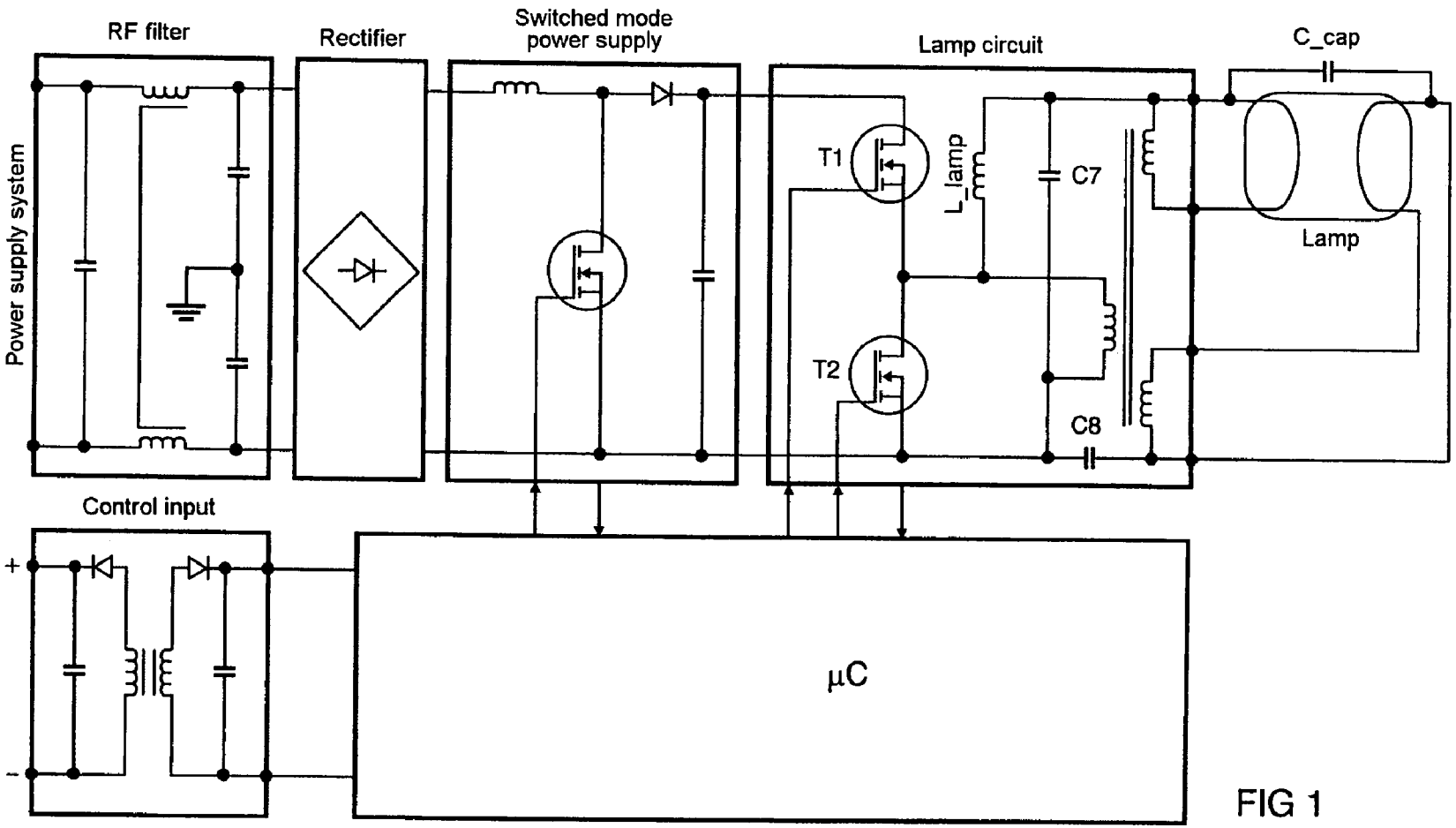
FIG. 1 shows a schematic block circuit diagram of a conventional illumination system.

Furthermore, FIG. 1 shows a winding (not given a reference), which is coupled to two windings (likewise not given references) which lie in parallel with the electrodes, between the center tap of the half-bridge comprising the two transistors T1 and T2 and the internal ground. Of concern here is a heating transformer which serves the purpose of heating the lamp electrodes prior to starting and during continuous operation at low dimming settings and is likewise known and therefore will not be explained further here.

The lamp circuit is supplied with a supply potential from a switched mode power supply which is connected at the top to the half-bridge comprising the two transistors T1 and T2. Of concern here is a step-up converter which has likewise long been known per se and which produces an approximately constant DC voltage at its output-side storage capacitor (not given a reference). For this purpose, it is supplied from a conventional AC power supply system via a radiofrequency filter (illustrated on the very left), which is likewise the prior art and does not need to be explained in any more detail, and a rectifier. The step-up converter is in this case used as a power factor correction circuit.

The lower, right-hand region in FIG. 1 illustrates a microcontroller μC which, on the one hand, as symbolized by the two arrows, controls the switched mode power supply, i.e. the step-up converter, and in the process specifically prescribes the clock of the switching transistor there and, on the other hand, is supplied by this switched mode power supply with the intermediate circuit voltage applied to the output-side capacitor. On the other hand, the microcontroller μC controls the two switching transistors T1 and T2 in the half-bridge and, in addition to the lamp voltage and the discharge resistance, in particular also measures the lamp current in the lamp circuit. The microcontroller μC is, inter alia, responsible for preheating control, starting control and monitoring of the lamp. In the context of this invention, however, the half-bridge control is of primary interest in the context of lamp current regulation. The microcontroller μC receives a dimming signal from a control input illustrated on the left-hand side, said dimming signal determining the rating, i.e. specifically the lamp current, which is used for regulation purposes. The control input is likewise prior art per se and will not be explained here in detail. In principle, this involves unipolar AC injection.

Figure 2:
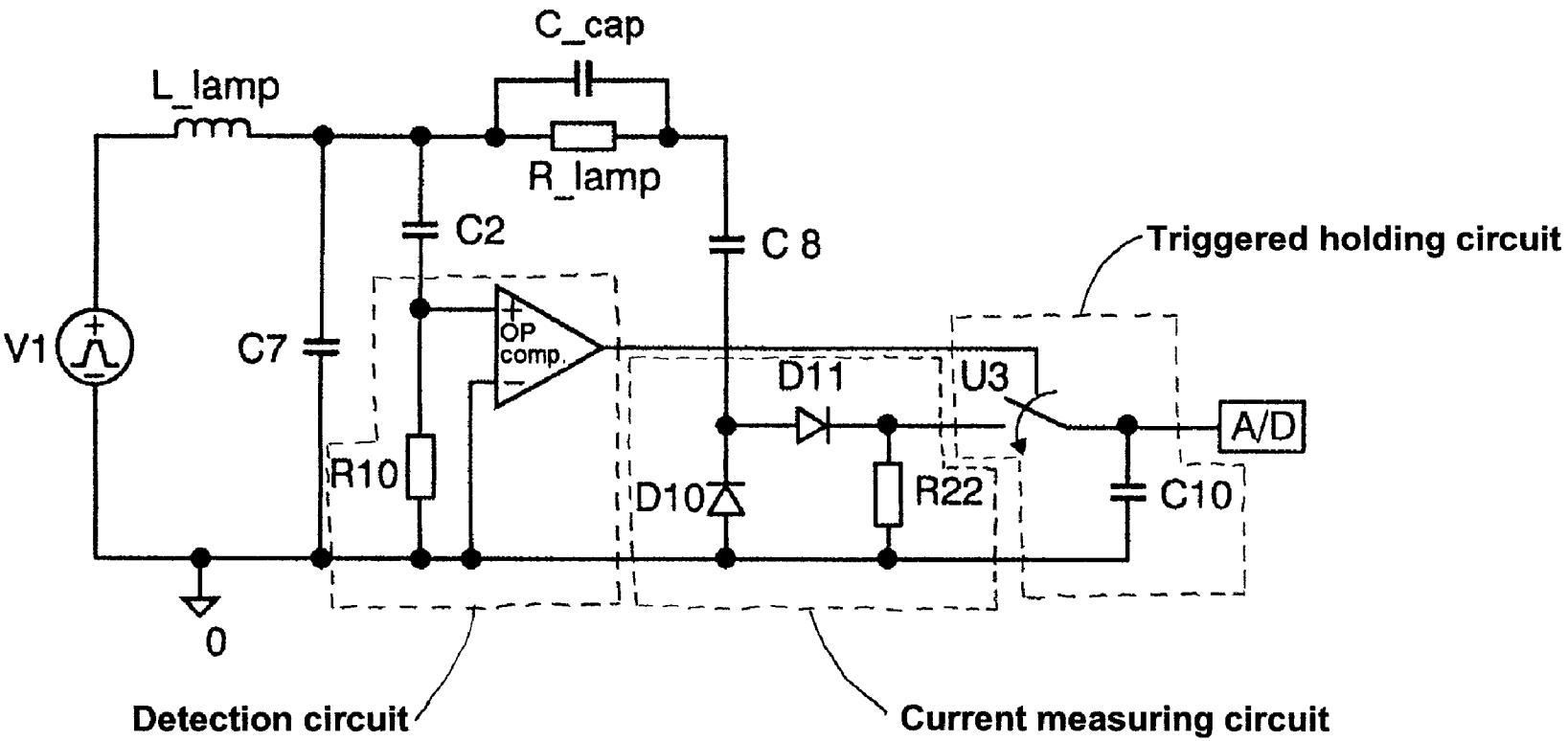
FIG. 2 shows part of an illumination system according to the invention with reference to FIG. 1.

FIG. 2 shows an exemplary embodiment of the invention, to be precise a detail of the part denoted "lamp circuit" in FIG. 1 including the lamp itself. In contrast to FIG. 1, FIG. 2 involves a circuit according to the invention, however.

Illustrated on the left-hand side is the half-bridge having the switching transistors T1 and T2, for reasons of simplicity in the form of a trapezoidal supply potential V1 between 0 and 470 V. This supply potential V1 lies between the left-hand terminal of the lamp inductor L_lamp and the internal ground in the lower region of FIG. 2. In FIG. 2, the lamp is illustrated approximately in the center at the top and is symbolized as a resistive active load R_lamp of, for example 25 kΩ having a parallel-connected parasitic capacitance C_cap of, for example, 250 pF.

The resonant capacitor C7 already explained with reference to FIG. 1 is illustrated and in this case has, for example, a capacitance of 3.3 nF. The coupling capacitor C8 with, for example, 20 nF is also provided. In addition to the half-bridge transistors T1 and T2, the preheating transformer shown in FIG. 1 is also omitted.

In FIG. 2, to a certain extent part of the resonant capacitor C7 is decoupled as a separator capacitor C2 with in this case 470 pF. This capacitor C2 lies in series with a measuring resistor R10 of in this case 100 Ω in parallel with the resonant capacitor and in parallel with the series circuit comprising the lamp R_lamp and the coupling capacitor C8.

The impedance of the resistor R10 is a great deal smaller than the impedance of the capacitor C2 (at typical frequencies of a few 10 kHz), with the result that substantially the total of the lamp voltage and the voltage across C8 lies across the capacitor C2. Since the voltage across C8 is practically constantly (over time) half the supply voltage of the half-bridge, changes to the voltage across the capacitor C2 should be associated with changes in the lamp voltage. These voltage changes across the capacitor C2 used in this case as the reactance in the sense of the invention are expressed in the form of currents, leading by 90°, through the measuring resistor R10. The voltage dropping across R10 as a result of these currents is detected via an OP comparator (operational amplifier circuit). Zero crossings and thus changes to the mathematical sign at the output of the comparator thus correspond, with a leading phase shift of 90°, to zero crossings of the lamp voltage. The capacitor C2 (or a corresponding inductance) therefore needs to be connected such that the lamp voltage is mapped therein.

The output of the comparator controls a transistor switch U3 which, in its closed state, connects a capacitor C10 of, for example, 47 nF in parallel with a measuring resistor R22 of, for example, 2.5 Ω and decouples it therefrom in its open state. The measuring resistor R22 lies in series with the coupling capacitor C8 and thus in the path of the lamp current. Owing to the diode D10 lying in parallel with said measuring resistor R22 and the diode D11 lying in series with said measuring resistor R22 having inverse polarity with respect to one another, only lamp currents of a specific polarity flow through the measuring resistor R22, however.

The voltages across R22 representing the lamp currents are applied to the capacitor C10 in the closed state of the switch U3 and thus charge said capacitor C10 to a corresponding value. If the switch U3 is opened, this voltage value across C10 is maintained. It is digitized via an analog-to-digital converter and passed on to a digital controller, corresponding to the microcontroller μC shown in FIG. 1. The switch U3 and the capacitor C10 thus form a track-and-hold circuit which, in the closed state of the switch U3, follows the voltage across R22, i.e. the lamp current, and holds it when the switch is opened.

In this example, the measurement of the currents through the capacitor C2 produces a leading phase shift of 90°. If the comparator and the switch U3, as in FIG. 2, are now connected such that the switch U3 is closed owing to a "1" at the output of the comparator at zero crossings from minus to plus and is opened again owing to a "0" at the output of the comparator at zero crossings from plus to minus, capacitor voltages across C10 thus remain stored at the last-mentioned zero crossing, and these capacitor voltages correspond to the lamp currents in the event of a phase shift of 180° with respect to the rising zero crossing of the current through C2 and thus 90° after the maximum of the current through C2. Owing to the leading phase shift of the current through C2 with respect to the active lamp current through R_lamp (in contrast to the capacitive reactive current through C_cap), these are precisely the positive current maxima without the reactive current component. The reactive current through C_cap likewise has a zero point at these times since it leads the active current by 90°.

This statement is true irrespective of the frequency and parasitic capacitance as long as the parasitic capacitances are markedly greater than the parasitic inductances.

Figure 3:
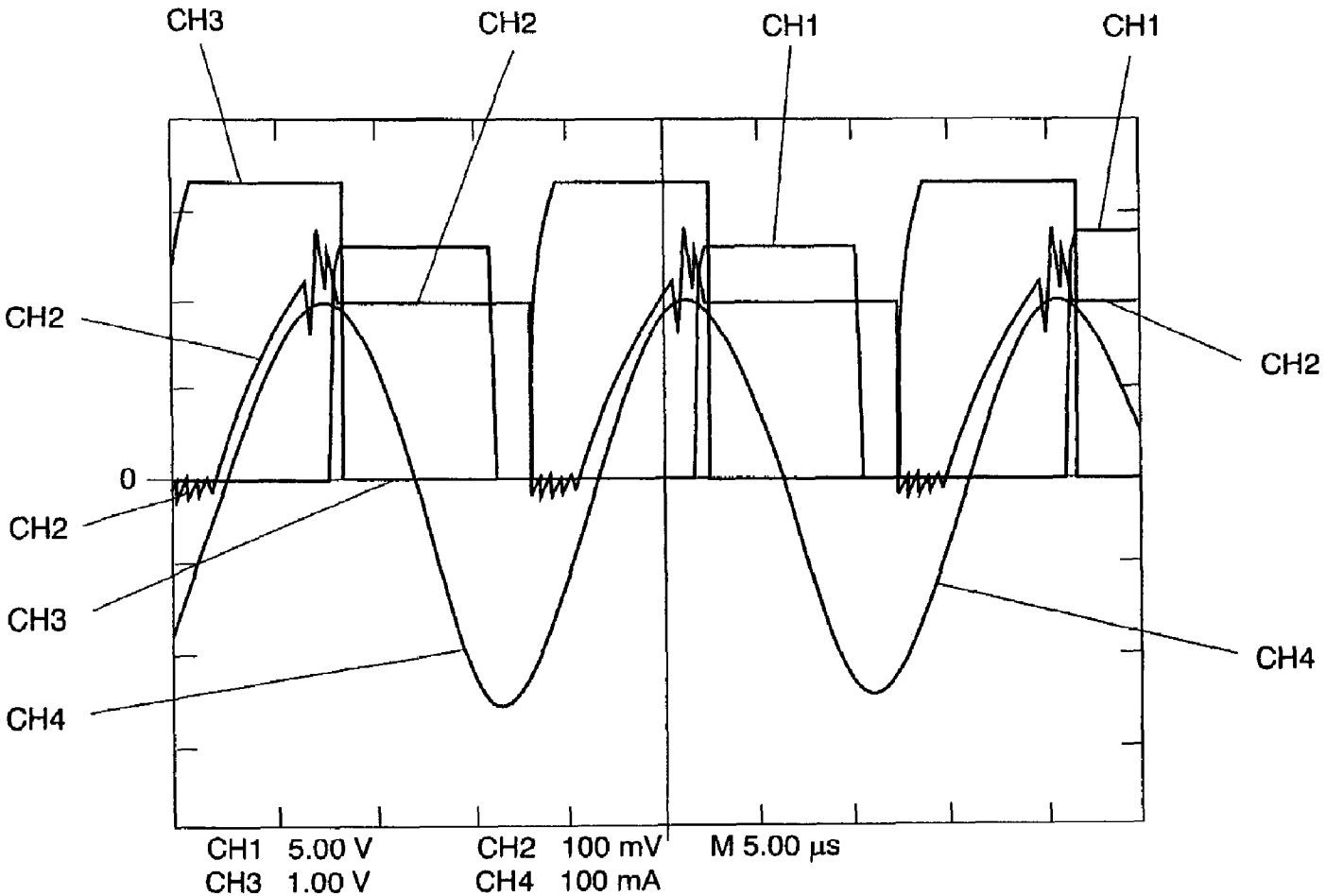
FIG. 3 shows measurement curves relating to the illumination system shown in FIG. 2.

FIG. 3 shows all of the measurement curves relating to the exemplary embodiment shown in FIG. 2. Therein, channel 1 (CH1) shows substantially a square-wave signal, namely the drive signal of the lower half-bridge transistor T2 and thus the working clock of the half-bridge. Channel 2 (CH2) shows the voltage across C10 and thus the input of the analog-to-digital converter. Channel 3 (CH3) shows the output of the comparator, i.e. the drive signal of the switch U3. Channel 4 (CH4) finally shows the lamp current which is approximately sinusoidal.

The zero point crossing from positive to negative can be seen from the abrupt interruption of the comparator output, i.e. the falling edge of the signal CH3. At this point in time, the switch U3 is opened, with the result that the curve CH2 then assumes a constant plateau until the signal CH3 again has a rising edge and the switch U3 is closed again. Immediately before and after the plateau, the curve CH2 shows a few smaller instances of interference which are caused by the half-bridge and are not of critical importance to the invention. If this interference is disregarded, in each case an image of the lamp current, i.e. of the signal CH4, is shown in the region in which switch U3 is closed, i.e. the high plateau of the signal CH3. This signal CH4 is substantially sinusoidal but has a slight phase lead with its maxima with respect to the falling edges of the signal CH3 and thus the maxima of the lamp voltage. This leading phase shift shows the influence of the capacitance reactive current. This influence is relatively low in the graph in FIG. 3 since in this case a relatively large dimming step has been selected for reasons of clarity of the illustration. With smaller dimming steps, this phase shift increases. However, since the plateau of the signal CH2 is in each case "frozen" at a point in time at which the reactive current component is precisely zero, these influences are not included in the lamp current regulation.

What is claimed is:

1. A circuit for operating a lamp, the circuit comprising:
- a reactance coupled to a first electrode of the lamp;
- a coupling capacitor coupled to a second electrode of the lamp;
- a detection circuit coupled to the reactance and operable to detect a zero crossing of a current flowing through the reactance;
- a current measuring circuit coupled to the coupling capacitor and to a circuit ground, the current measuring circuit being operable to measure the current flowing through the coupling capacitor; and
- a triggered holding circuit coupled to the detection circuit and to the current measuring circuit, the triggered holding circuit being operable to hold the value of the current measured by the current measuring circuit at a point in time corresponding to detection of the zero crossing of the current flowing through the reactance.

2. The circuit of claim 1, wherein the reactance is a capacitor.

3. The circuit of claim 1, wherein the detection circuit comprises:
- a measuring resistor coupled in series with the reactance; and
- a comparator having a non-inverting (+) input, an inverting (−) input, and an output, wherein the non-inverting input is coupled to a junction of the reactance of the measuring resistor, and the inverting input is coupled to circuit ground.

4. The circuit of claim 1, wherein the current measuring circuit is operable to measure current values of only one polarity.

5. The circuit of claim 1, wherein the current measuring circuit comprises:
- a first diode coupled between the coupling capacitor and circuit ground;
- a second diode coupled to a junction between the first diode and the coupling capacitor; and
- a resistor coupled between the second diode and circuit ground.

6. The circuit of claim 1, wherein the triggered holding circuit is a track-and-hold circuit.

7. The circuit of claim 1, wherein the triggered holding circuit comprises:
- a controlled switch coupled to the detection circuit and to the current measuring circuit, wherein the controlled switch has an on state and an off state; and a capacitor coupled to the transistor switch, wherein the capacitor is operably coupled to the current measuring circuit when the controlled switch is in the on state.

8. The circuit of claim 7, wherein the controlled switch is a transistor.

9. The circuit of claim 1, further comprising an analog-to-digital converter coupled to the triggered holding circuit.

10. The circuit of claim 1, wherein:

the detection circuit comprises:

a measuring resistor coupled in series with the reactance; and a comparator having a non-inverting (+) input, an inverting (−) input, and an output, wherein the non-inverting input is coupled to a junction of the reactance of the measuring resistor, and the inverting input is coupled to circuit ground;

the current measuring circuit comprises:

a first diode coupled between the coupling capacitor and circuit ground;

a second diode coupled to a junction between the first diode and the coupling capacitor; and a resistor coupled between the second diode and circuit ground; and the triggered holding circuit comprises:

a controlled switch coupled to the output of the comparator within detection circuit and to the current measuring circuit, wherein the controlled switch has an on state and an off state; and a capacitor coupled to the transistor switch, wherein the capacitor is operably coupled to the current measuring circuit when the controlled switch is in the on state.

11. A method for monitoring a current flowing through a lamp, the method comprising the steps of:

providing a reactance for monitoring a voltage across the lamp;

determining a zero-crossing of a current flowing through the reactance;

measuring a current flowing through a coupling capacitor that is coupled in series with the lamp; and holding the value of the measured current at a point in time corresponding to the zero-crossing of the current flowing through the reactance, at which point in time the value of the measured current substantially corresponds to the amplitude of the current flowing through the lamp.

* * * * *